US011519111B2

(12) United States Patent
Hergeth

(10) Patent No.: US 11,519,111 B2
(45) Date of Patent: Dec. 6, 2022

(54) METHOD AND APPARATUS FOR FORMING A FIBER NONWOVEN

(71) Applicant: Hubert Hergeth, Zug (CH)

(72) Inventor: Hubert Hergeth, Zug (CH)

(73) Assignee: Hubert Hergeth, Zug (CH)

( * ) Notice: Subject to any disclaimer, the term of this patent is extended or adjusted under 35 U.S.C. 154(b) by 146 days.

(21) Appl. No.: 16/984,895

(22) Filed: Aug. 4, 2020

(65) Prior Publication Data

US 2021/0040659 A1 Feb. 11, 2021

(30) Foreign Application Priority Data

Aug. 7, 2019 (DE) ..... 10 2019 005 550.0

(51) Int. Cl.
*D04H 1/732* (2012.01)
*D01G 23/00* (2006.01)
*D04H 1/70* (2012.01)

(52) U.S. Cl.
CPC ..... *D04H 1/732* (2013.01); *D01G 23/00* (2013.01); *D04H 1/70* (2013.01)

(58) Field of Classification Search
CPC ..... D04H 1/732; D04H 1/70; D01G 23/00
See application file for complete search history.

(56) References Cited

U.S. PATENT DOCUMENTS 2,925,360 A * 2/1960 Roberts ..... B27N 3/14 425/81.1
6,732,412 B2 * 5/2004 Collotte ..... D01G 15/465 19/296
2014/0027075 A1 * 1/2014 Yamagami ..... D21B 1/063 162/4
2016/0355960 A1 * 12/2016 Young ..... D21H 27/002
2018/0169892 A1 * 6/2018 Ueno ..... D04H 1/732
2020/0173105 A1 * 6/2020 Higuchi ..... D21F 9/00
2020/0173106 A1 * 6/2020 Higuchi ..... D21F 7/00

FOREIGN PATENT DOCUMENTS

| | | | |
|---|---|---|---|
| AT | 44 294 | E | 1/1990 |
| DE | 10 2010 034 776 | A1 | 2/2012 |
| DE | 10 2011 120 715 | A1 | 6/2013 |
| DE | 10 2016 009 679 | A1 | 2/2018 |
| EP | 0 093 585 | B1 | 6/1989 |
| EP | 1 493 854 | A1 | 1/2005 |

OTHER PUBLICATIONS

Search Report for German Application No. 10 2019 005 550.0, dated Apr. 15, 2020.
Bernhardt, 3D fiber orientation with the airlaid technique. Technical Textiles—Nonwovens. 2001;3:64-7.

* cited by examiner

*Primary Examiner* — Shaun R Hurley
(74) *Attorney, Agent, or Firm* — Wolf, Greenfield & Sacks, P.C.

(57) ABSTRACT

An aerodynamic nonwoven formation, in which the nonwoven formation occurs in the operating range of a milling roller. The nonwoven formation takes place using a fiber opening unit, a moving screening surface with suction and a milling roller. The nonwoven-forming fibers are removed from the fiber opening roller and form a nonwoven after a flight or slide route. The nonwoven formation takes place in an area that is limited by an angle a against the direction of movement of the screen and by an angle β with the movement of the screen relative to a section from the center of the milling roller to the screening belt.

4 Claims, 1 Drawing Sheet

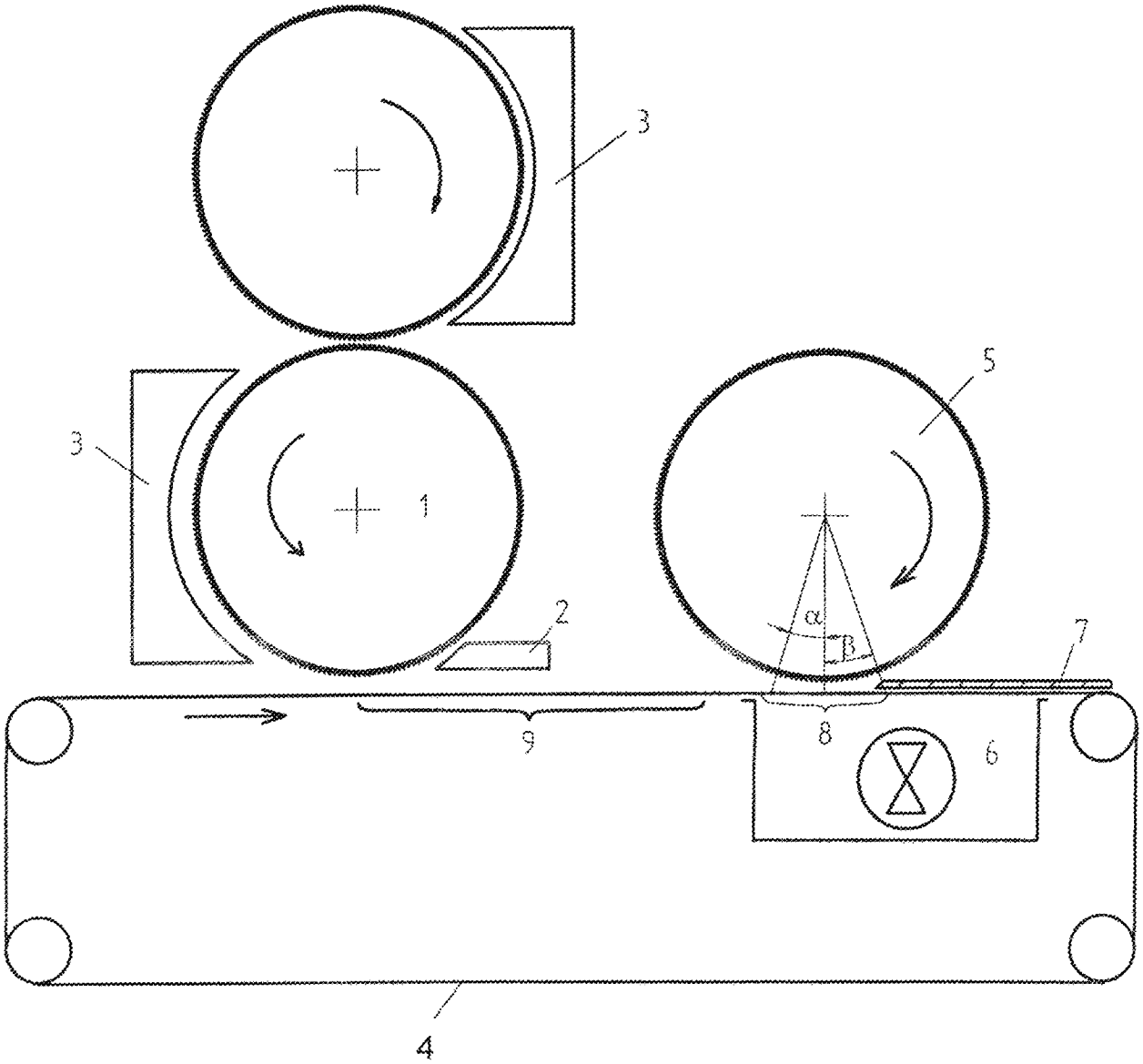
3
5
7
6
2
1
3
α
β
8
9
4

METHOD AND APPARATUS FOR FORMING A FIBER NONWOVEN

RELATED APPLICATIONS

Foreign priority benefits are claimed under 35 U.S.C. § 119(a)-(d) or 35 U.S.C. § 365(b) of German application no. 10 2019 005 550.0, filed Aug. 7, 2019, which is incorporated by reference herein.

BACKGROUND

In the nonwoven industry, two methods are commonly used for the production of nonwovens from staple fibers longer than 20 mm.

Carding machines are used for the production of nonwovens which mainly comprise fibers oriented in the running direction (machine direction MD).

Using the aerodynamic method, it is attempted to produce a nonwoven with random fiber orientation.

A new development, i.e. DE 10 20169679 A1, attempts to align the fibers by means of a chute in the aerodynamic nonwoven formation.

This construction was still based on the usual fiber removal point from the last cylinder before the nonwoven formation. However, the chute causes a strong orientation perpendicular to the delivery direction (CD) and makes it difficult to align the fibers in the running direction (MD).

An object of the disclosure is to provide a fiber layer which allows in a simple manner to deposit fibers both in MD and CD orientation.

The definition of the nonwoven forming point is significant for the disclosure. Fibers or small flakes are removed from the last garnished cylinder. Occasionally, these fibers or small flakes fly or slide away from this cylinder towards the nonwoven forming point. At the nonwoven forming point, the fibers or flakes are significantly slowed down by their flying or sliding speed, and are combined into a nonwoven. The fibers/flakes no longer move individually but have contact to the other fibers/flakes. Occasionally, this contact and the slowing down can also even occur prior to the nonwoven forming point or line.

Therefore, the nonwoven forming point is defined here as the place or line where the largest number of combinations occurs. This is usually the place where the greatest suction is made.

According to one aspect, the nonwoven formation takes place using a fiber opening unit, a moving screening surface with suction and a milling roller. The nonwoven-forming fibers are removed from the fiber opening roller and form a nonwoven after a flight or slide route. The nonwoven formation takes place in an area that is limited by an angle $\alpha$ against the direction of movement of the screen and by an angle $\beta$ with the movement of the screen (with respect to a section from the center of the milling roller to the screening belt). On the section from removal of the fibers/flakes up to approximately the nonwoven formation, the fibers fly or slide individually or in flakes.

A milling roller is a cylinder configured with a fiber-entraining surface.

Conventional aerodynamic nonwoven productions start from a duct which widens in the area of the nonwoven formation after the fiber removal point of the last opening roller. A narrowing duct leads to blockages. Using the milling roller of the disclosure, a narrowing duct can be formed, without clogging the duct.

SUMMARY

According to one embodiment, a method is provided for forming a fiber nonwoven. The method comprises sucking fibers or flakes onto a moving screening surface; operating a milling roller in a suction area; and forming the nonwoven in an area between the screening surface and the milling roller. An initial area of the nonwoven formation is defined by a first intersection of a first straight line originating from the center of the milling roller with the screening surface, the first straight line forming, together with a section extending perpendicular from the center of the milling roller to the screening surface, a first angle ($\alpha$) of 0° to 20° against the direction of movement of the screen. An end area of the nonwoven formation is defined by a second intersection of a second straight line originating from the center of the milling roller with the screening surface, the second straight line forming with the section a second angle ($\beta$) of 0° to 30° in the direction of movement of the screen.

According to one embodiment, a device for forming a fiber nonwoven comprises a moving screening surface onto which fibers or flakes are to be sucked, a milling roller configured to operate in a suction area, and a nonwoven formation area located between the screening surface and the milling roller. The nonwoven formation area is defined by a first intersection of a first straight line originating from the center of the milling roller with the screening surface and a second intersection of a second straight line originating from the center of the milling roller with the screening surface. The first straight line forms, together with a section extending perpendicular to the screening surface from the center of the milling roller, a first angle ($\alpha$) of 0°-20° against the direction of movement of the screen. The second straight line forms with the section a second angle ($\beta$) of 0° to 30° in the direction of movement of the screen.

BRIEF DESCRIPTION OF DRAWINGS

FIG. 1 shows one embodiment example of the disclosure.

DETAILED DESCRIPTION

The fibers are fed to the system via an opening unit consisting of a feeder and a cylinder.

The fibers also come off from the roller 1) using a knife 2). Troughs 3) prevent premature removal of the fibers from the garnished cylinders.

A screening belt 4) moves from the fiber feed towards the milling roller 5).

A low pressure is generated at a suction box 6), and a nonwoven 7) is formed. The nonwoven is produced below the milling roller 5), i.e. in an area 8) which is defined by angles $\alpha$) and $\beta$) with respect to the section from the center of the milling roller to the screening belt.

The slide or flight route 9) extends between the removal of the fibers/flakes from the cylinder 1) and the nonwoven formation.

The nonwoven formation is thus carried out by means of a fiber opening unit, a moving screening surface 4) with a suction 6) and a milling roller 5), at which the nonwoven-forming fibers are removed from the fiber opening roller 1) and form a nonwoven after a flight or slide route 9), and the nonwoven formation occurs in an area 8) that is limited by an angle $\alpha$ against the direction of movement of the screen and by an angle β with the movement of the screen. On section 9), i.e. from the removal of the fibers/flakes up to approximately the nonwoven formation, the fibers fly or slide individually or in flakes.

In earlier applications, it was assumed that the nonwoven is formed in front of the operating range of the milling roller 5). This causes a rolling of the fibers and results in a non-uniform nonwoven. The formation of the nonwoven in the direct operating range of the milling roller makes the nonwoven more uniform and allows the production of nonwovens having a predetermined MD/CD.

The disclosure comprises the following method and the following device:

1) A method for forming a fiber nonwoven, in which fibers or flakes are sucked onto a moving screening surface. A milling roller operates in the suction area, and the nonwoven formation occurs in an area between the screening surface and the milling roller. The initial area of the nonwoven formation is to be impinged by a beam from the center of the milling roller onto the screening surface, with the beam having an angle of 0° to 20° with respect to the section from the center onto the screening surface against the direction of movement of the screen. The end area is to be impinged by a beam having an angle of 0° to 30° with respect to the same section in the direction of movement of the screen.

2) A device for forming a fiber nonwoven, in which fibers or flakes are sucked onto a moving screening surface. A milling roller operates in the suction area, and the nonwoven formation occurs in an area between the screening surface and the milling roller. The suction area is to be impinged by a beam from the center of the milling roller onto the screening surface, with the beam having an angle of 0° to 20° with respect to the section from the center onto the screening surface against the direction of movement of the screen. The end area is to be impinged by a beam having an angle of 0° to 30° with respect to the same section in the direction of movement of the screen.

What is claimed is:

1. A method for forming a fiber nonwoven, the method comprising:

sucking nonwoven-forming fibers or flakes onto a moving screening surface;

operating a milling roller with a fiber-entraining surface in a suction area; and forming the nonwoven in a nonwoven formation area between the screening surface and the milling roller, the nonwoven formation area including an initial area and an end area, the initial area of the nonwoven formation area being defined by a first intersection of a first straight line originating from the center of the milling roller with the screening surface, the first straight line forming, together with a section extending perpendicular from the center of the milling roller to the screening surface, a first angle (α) of 0° to 20° against the direction of movement of the screening surface, and the end area of the nonwoven formation area being defined by a second intersection of a second straight line originating from the center of the milling roller with the screening surface, the second straight line forming with the section a second angle (β) of 0° to 30° in the direction of movement of the screening surface.

2. The method according to claim 1, further comprising feeding nonwoven- forming fibers or flakes onto the moving screening surface from a fiber opening roller; and transporting the nonwoven-forming fibers or flakes with the moving screening surface along a flight or slide route to the suction area located downstream from the fiber opening roller.

3. A device for forming a fiber nonwoven, the device comprising:

a moving screening surface onto which nonwoven-forming fibers or flakes are to be sucked;

a milling roller with a fiber-entraining surface located at a suction area; and a nonwoven formation area located between the screening surface and the milling roller, the nonwoven formation area being defined by a first intersection of a first straight line originating from the center of the milling roller with the screening surface, the first straight line forming, together with a section extending perpendicular to the screening surface from the center of the milling roller, a first angle (α) of 0°-20° against the direction of movement of the screening surface and by a second intersection of a second straight line originating from the center of the milling roller with the screening surface, the second straight line forming with the section a second angle (β) of 0° to 30° in the direction of movement of the screening surface.

4. The device according to claim 3, further comprising a fiber opening roller configured to feed the nonwoven-forming fibers or flakes onto the moving screening surface.

* * * * *